US009396601B2

(12) United States Patent
Go et al.

(10) Patent No.: US 9,396,601 B2
(45) Date of Patent: Jul. 19, 2016

(54) CASH BOX WITH TWO LOCKING UNITS

(71) Applicant: Wincor Nixdorf Internatinal GmbH, Paderborn (DE)

(72) Inventors: Florante Go, Singapur (SG); Hengky Wirawan, Singapur (SG)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/427,685

(22) PCT Filed: Sep. 11, 2013

(86) PCT No.: PCT/EP2013/068791
§ 371 (c)(1),
(2) Date: Mar. 12, 2015

(87) PCT Pub. No.: WO2014/041014
PCT Pub. Date: Mar. 20, 2014

(65) Prior Publication Data

US 2015/0248802 A1 Sep. 3, 2015

(30) Foreign Application Priority Data

Sep. 14, 2012 (EP) ..... 12184438

(51) Int. Cl.
*G07D 11/00* (2006.01)

(52) U.S. Cl.
CPC ..... *G07D 11/0009* (2013.01)

(58) Field of Classification Search
CPC ..... G07D 11/0009; G07D 11/0012; E05B 65/0075; E05G 1/04; E05G 1/026; E05G 1/005; E06B 9/02; E06B 9/11; G07F 19/202; G07F 19/203; B65H 2701/1912
USPC ..... 232/1 D, 15, 16, 43.2; 194/350; 109/59 R, 64, 66; 70/63; 902/9, 13; 220/324; 235/379
See application file for complete search history.

(56) References Cited

U.S. PATENT DOCUMENTS

| | | | | |
|---|---|---|---|---|
| 4,275,667 | A | 6/1981 | Hilton | |
| 4,529,119 | A * | 7/1985 | Granzow | E05G 5/006 109/43 |
| 4,570,548 | A * | 2/1986 | Martin | G07D 11/0009 109/24.1 |
| 4,638,746 | A * | 1/1987 | Ishigure | G07D 11/0009 109/52 |

(Continued)

FOREIGN PATENT DOCUMENTS

| | | | |
|---|---|---|---|
| DE | 2949344 | A1 | 6/1980 |
| DE | 102008044838 | A1 | 3/2010 |
| EP | 0263680 | A1 | 4/1988 |

OTHER PUBLICATIONS

International Preliminary Report on Patentability for PCT/EP2013/068791 (Mar. 26, 2015) with English Translation (11 pages).

(Continued)

*Primary Examiner* — William Miller
(74) *Attorney, Agent, or Firm* — Harness, Dickey & Pierce, P.L.C.

(57) ABSTRACT

The disclosure relates to a cash box comprising a housing with an opening for feeding and/or removing notes of value and a closing unit for closing the opening. Further, the cash box has a locking unit which, in a locked state, prevents the opening of the closing unit and, in an unlocked state, enables an opening.

15 Claims, 7 Drawing Sheets

(56) References Cited

U.S. PATENT DOCUMENTS

| | | | | |
|---|---|---|---|---|
| 4,890,766 | A * | 1/1990 | Martin | B65H 1/12 109/67 |
| 6,059,090 | A * | 5/2000 | Davis | G07B 15/066 194/350 |
| 8,500,000 | B2 * | 8/2013 | Berendes | G07D 11/0009 109/64 |
| 8,887,986 | B2 * | 11/2014 | Berendes | G07D 11/0009 109/45 |
| 8,935,884 | B2 | 1/2015 | Pang et al. | |
| 2011/0155736 | A1 * | 6/2011 | Berendes | G07D 11/0009 220/324 |
| 2013/0100014 | A1 | 4/2013 | Rabanos et al. | |
| 2014/0368102 | A1 | 12/2014 | Go | |
| 2015/0246780 | A1 * | 9/2015 | Geesmeier | B65H 1/26 271/264 |

OTHER PUBLICATIONS

International Search Report (in English and German) for PCT/EP2013/068791, mailed Feb. 17, 2014; ISA/EP.

European Search Report (in German) for priority application EP 12184438.5, dated Feb. 5, 2013.

* cited by examiner

CASH BOX WITH TWO LOCKING UNITS

CROSS-REFERENCE TO RELATED APPLICATIONS

This application is a 371 National Stage of International Application No. PCT/EP2013/068791, filed on Sep. 11, 2013, and published in German as WO 2014/041014 A1 on Mar. 20, 2014. This application claims the benefit of and priority to European Application No. 12184438.5, filed on Sep. 14, 2012. The entire disclosures of the above applications are hereby incorporated by reference.

BACKGROUND

This section provides background information related to the present disclosure which is not necessarily prior art.

TECHNICAL FIELD

The disclosure relates to a cash box comprising a receiving area for receiving a value note stack, a housing having an opening for automatically feeding notes of value to the receiving area and/or for removing notes of value from the receiving area by means of a stacking module, and a closing unit for closing this opening of the housing. In a closed position, the closing unit closes the opening, wherein, in an open position in which the closing unit has been moved in an opening direction relative to the closed position, it uncovers an opening at least so far that notes of value are feedable and/or removable. Further, the cash box comprises a locking unit which, in a locked state, prevents an opening of the closing unit arranged in the closed position and, in an unlocked state, enables an opening. The locking unit comprises a first engaging element which is mounted to the housing and which, in the locked state, is arranged in a locking position in which it engages with a second engaging element of the closing unit.

DISCUSSION

From the document DE 10 2008 044 838 A1, a cash box is known which has an opening for feeding and removing notes of value, which opening is closable by a closing unit. Further, a locking unit is provided by means of which the closing unit can be locked. Here, the locking unit is designed such that an engagement element projects through the wall of the housing of the cash box in the locked position, and, for unlocking, is movable into the cash box against a spring force of a spring. For this, in particular in the automated teller machines which are intended to receive this cash box, corresponding raised portions are provided on the rails along which the cash box is guided, which raised portions, upon insertion of the cash box, automatically move the engagement element from the locked into the unlocked state so that the closing unit can be opened.

What is problematic with such cash boxes is that in the same manner also an unauthorized person can open the closing unit and thus has access to the notes of value received in the receiving area without this being noticed without counting the notes of value. Thus, an immediate detection of a such a theft is not possible, and it is difficult to say who committed the theft.

SUMMARY OF THE DISCLOSURE

It is an object of the disclosure to specify a cash box by means of which manipulation attempts are detectable in an easy manner.

According to the disclosure, the closing unit comprises a third engagement element which is arranged and designed such that the first engagement element arranged in the locking position engages with said third engagement element when the engagement between the first engagement element and the second engagement element is disengaged and the closing unit is moved in the opening direction without the first engagement element being held in the unlocked position.

By the engagement between the first engagement element and the third engagement element, a re-locking of the closing unit is achieved, the closing unit being arranged in an intermediate position between the closed position and the open position. Thus, it can easily be detected that someone had tried to open the closing unit in an unauthorized manner, as a result whereof action against such a manipulation attempt can be taken immediately. Here, an engagement between the first and the third engagement element can be established in the attempt of opening the closing unit as well as not until after the manipulation attempt when closing the closing unit again. In both cases, the closing unit is arranged in a special intermediate position by means of which the manipulation attempt can be detected in an easy manner. If the engagement is established already during the opening, then in particular no access to the notes of value is possible. For this, the intermediate position in which the closing unit is arranged when the first and the third engagement element are engaged with each other is in particular chosen such that no access to the notes of value is possible.

The closing unit is constructed in particular like a roller shutter. It is particularly advantageous when the closing unit comprises a plurality of slats having a first width and a base plate having a second width, the second width being greater than the first width. By means of the slats it is achieved that at least this partial area of the closing unit can easily adapt to a round contour so that, in the closed position, the area of the closing unit with the slats is designed in particular in a curved manner and closes the opening, but, in the open position, is linearly received in a receiving slot in the area of the bottom of the cash box.

Alternatively, the closing unit may also comprise a curved element and a base plate connected to this curved element in an articulated manner.

In both embodiments the base plate is in particular arranged at the front end of the closing unit, as viewed in opening direction.

It is advantageous when both the second engagement element and the third engagement element are arranged in the base plate. In this way, a far more stable structure, as compared to the arrangement of the engagement elements on one of the slats, can be achieved so that a safe, reliable locking is possible.

The second engagement element and/or the third engagement element are in particular designed as a recess in the closing unit. Thus, the first engagement element in the locked state engages with the second recess and in this way prevents an opening of the closing unit. Accordingly, the first engagement element engages with the third recess, when the engagement of the first engagement element with the second recess is disengaged and the closing unit had been moved without the first engagement element being held in the unlocked state.

The third engagement element is preferably arranged upstream of the second engagement element, as viewed in the opening direction. Thus, the first engagement element, if it is not held in the unlocked state all the time, automatically engages with the third engagement element when the closing element is moved in the opening direction so that such a manipulation attempt can easily be detected.

The distance between the second engagement element and the third engagement element is in particular chosen such that the closing unit, when the first engagement element engages with the third engagement element, closes the opening at least so far that no access to the notes of value received in the receiving area is possible. Thus, it is achieved that no notes of value can be stolen.

The distance between the second engagement element and the third engagement element is in particular chosen such that the closing unit, when the first engagement element engages with the third engagement element, is arranged in an intermediate position which can be well distinguished visually from the closed position so that the presence of a manipulation attempt is easily and reliably detectable.

The third engagement element is in particular designed such that the engagement between the first and the third engagement element can only be disengaged again by the opening of a cover of the cash box. In this way, it is guaranteed that, once the engagement between the third and the first engagement element is established, this engagement may only be disengaged by authorized service staff. For opening the cover of the cash box, it is in particular necessary to have a key so that only authorized service staff can open the cover. The cover in particular serves to close an opening of the cash box for manually feeding and removing notes of value.

Thus, it is in particular achieved that a person who tries in an unauthorized manner to gain access to the notes of value and does not hold the engagement element in the unlocked position during the entire travel of the closing unit, no longer has the chance, after engagement of the first engagement element with the third engagement element, to undo this mistake, and thus it is guaranteed that this manipulation attempt or the manipulation performed is actually detected.

The third engagement element is in particular designed and/or arranged such that the first engagement element, when arranged in the locking position, engages with the third engagement element when moving the closing unit from the open position into the closed position.

The first engagement element is in particular biased by means of an elastic element into the locking position and movable against this restoring force of this elastic element in an unlocking direction into an unlocking position in which it is arranged in the unlocked state of the locking unit. By biasing into the locking position it is achieved that the first engagement element is automatically moved into this locking position as soon as it is no longer actively held in the unlocking position. In particular, thus the first engagement element again moves into the locking position when it is released again after manual actuation so that it will engage with the third engagement element when it is released too early.

The first engagement element, when held in the unlocking position against the restoring force, does not engage with the second and not with the third engagement element either when the closing unit is moved from the closed into the open position and/or from the open into the closed position. Thus, despite this further safety measure by means of the third engagement element, the closing unit can safely and reliably be opened and closed when the first engagement element is adjusted as planned.

Further, it is advantageous when the third engagement element, when engaged with the first engagement element, prevents a movement of the first engagement element in the unlocking direction. Thus, it is prevented that the engagement between the first and the third engagement element can be disengaged.

For this, the third engagement element in particular comprises a limiting element which delimits a receiving area in which at least a partial area of the first engagement element is received when the first engagement element and the second engagement element are engaged with each other toward the unlocking direction. The limiting element is preferably designed in the form of a projection or a wall of a recess.

In contrast hereto, the second engagement element is in particular designed such that it only has one lateral boundary so that a movement in the unlocking direction is possible and thus the first engagement element is adjustable between the locking position and the unlocking position.

BRIEF DESCRIPTION OF THE DRAWINGS

The drawings described herein are for illustrative purposes only of selected embodiments and not all possible implementations, and are not intended to limit the scope of the present disclosure.

Further features and advantages of the disclosure result from the following description which explains the disclosure in more detail on the basis of embodiments in connection with the enclosed Figures.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
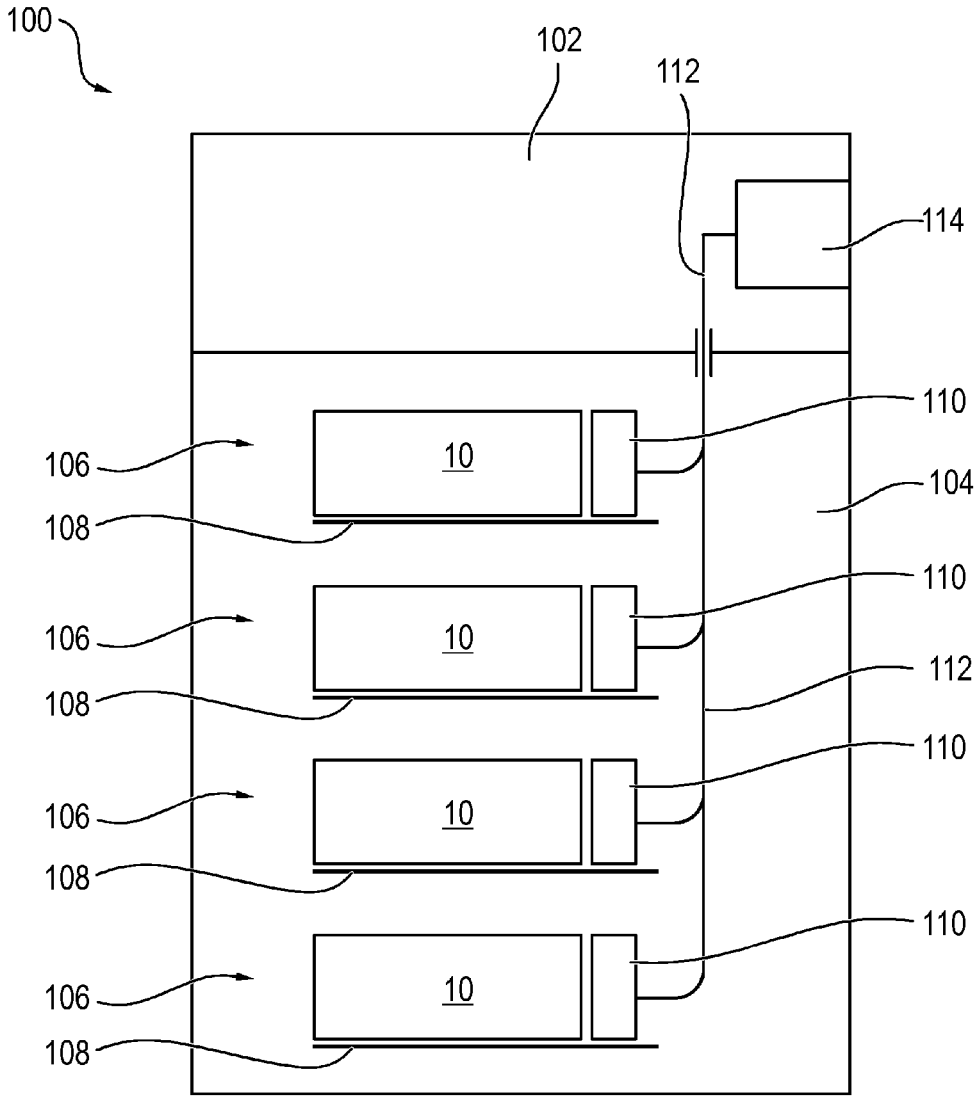
FIG. 1 shows a schematic illustration of an automated teller machine with four cash boxes received therein.

In FIG. 1, a schematic illustration of an automated teller machine 100 is shown. The automated teller machine 100 comprises a head module 102 and a safe module 104 in which four receiving areas 106 for receiving one cash box 10 each are provided. Each of the receiving areas 106 has a guiding unit 108 by means of which the cash box 10 received in the respective receiving area 106 is held in said receiving area 106.

A pull-off and/or stacking module 110 is assigned to each receiving area 106, by means of which notes of value can be fed to the respective cash box 10 and/or removed therefrom.

By means of a transport unit, notes of value can be transported along a transport path 112 between the stacking and/or pull-off modules 110 and an input and/or output compartment 114 in the head module 102 of the automated teller machine 100 so that deposited notes of value can be fed to the cash boxes 10 and/or notes of value removed from the cash boxes 10 can be output via the input and/or output compartment 114 to a user of the automated teller machine 10.

Figure 2:
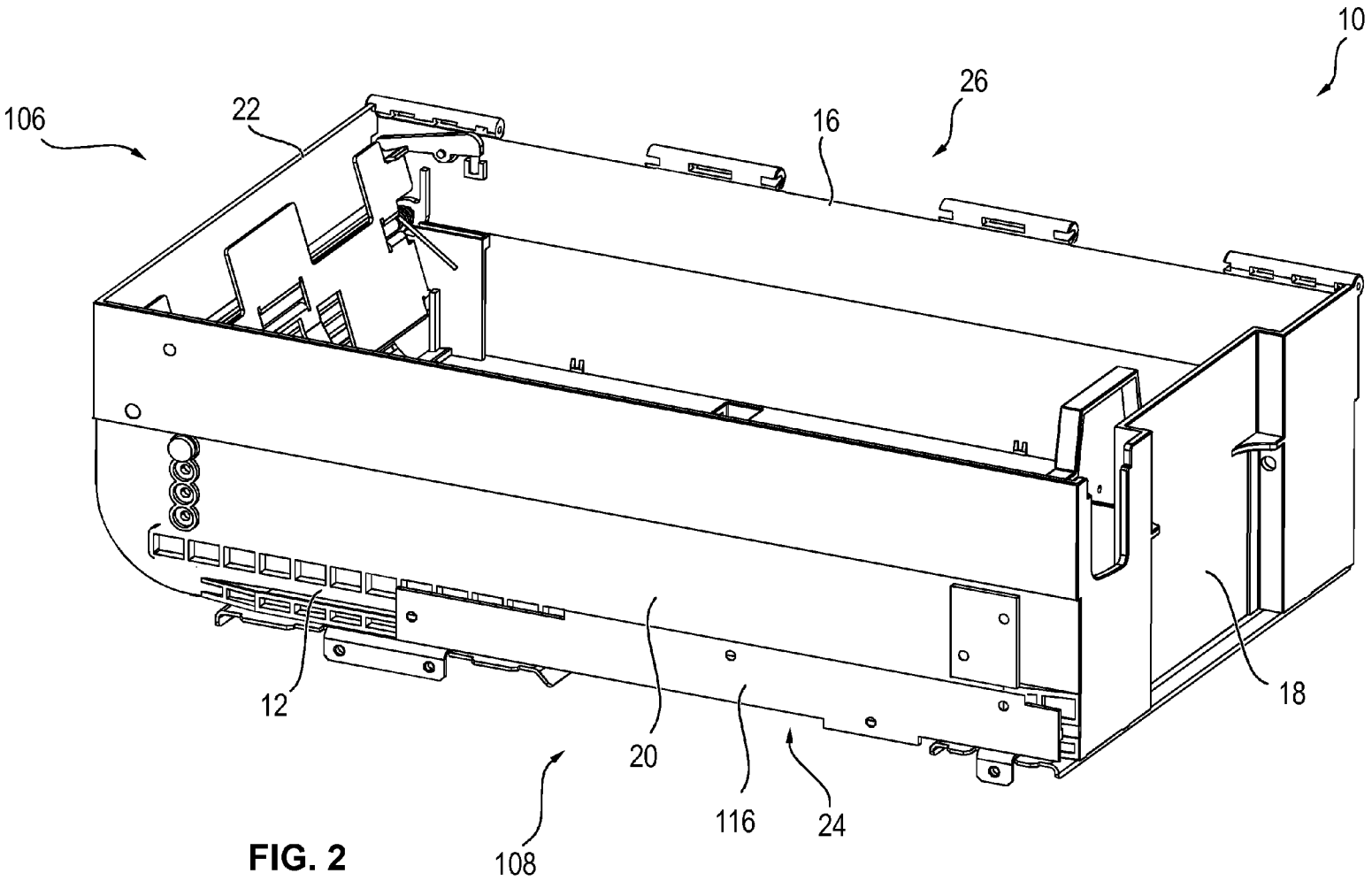
FIG. 2 shows a schematic illustration of a receiving area of the automated teller machine according to FIG. 1 and a cash box received therein.

FIG. 2 shows a schematic perspective illustration of one of the receiving areas 106 and a cash box 10 received therein. The guiding unit 108 has rails 116 on both sides of the cash box 10 which have raised portions which are not visible in FIG. 2 and engage with complementary recesses 12 of the cash box 10 and thus hold the cash box 10 in the receiving area 106.

Figure 3:
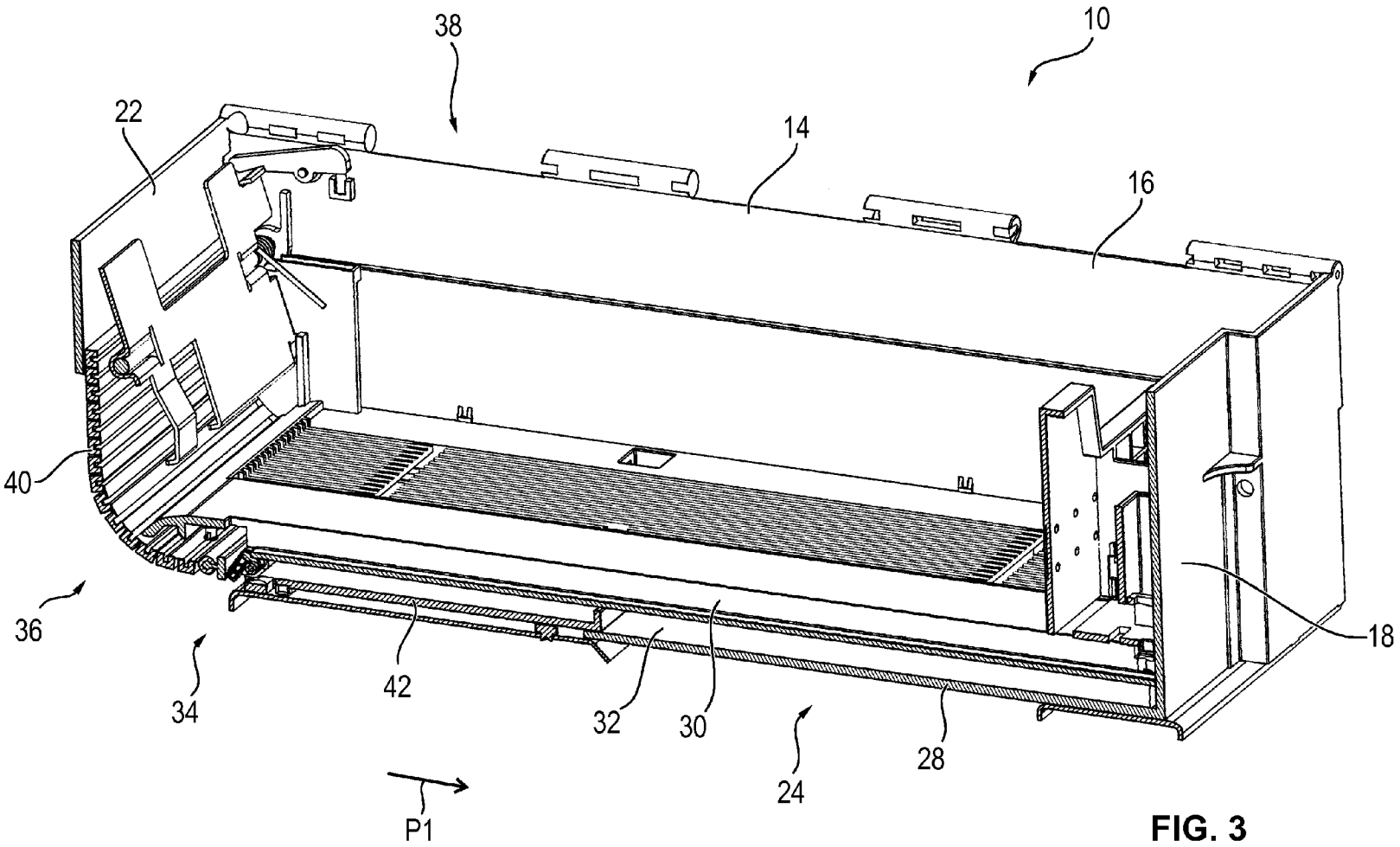
FIG. 3 shows a sectional view of the cash box according to FIG. 2.

In FIG. 3, a schematic perspective sectional view of the cash box 10 is shown. The cash box 10 has a housing 14 comprising four sidewalls 16 to 22, a bottom unit 24 and a cover which is not illustrated for a better visibility of the inner components of the cash box 10. By means of the cover, an opening 26 for manually feeding and/or removing notes of value and for maintaining the cash box 10 can be closed.

The bottom unit 24 of the housing 14 is designed in the form of a double bottom comprising a lower bottom element 28 and an upper bottom element 30 between which a receiving slot 32 is formed in which a closing unit 34 for closing an opening 36 for the automatic feeding and/or removing of the notes of value via the stacking and/or pull-off modules 110 in an open position in which the closing unit 34 does not close the opening 36 can be received.

In FIG. 3, on the other hand, the closing unit 34 is arranged in a closed position in which it closes the opening 36 so that an access to notes of value received in the receiving area 38 of the cash box 10 is not possible.

The closing unit 34 has a slat-like area 40 and a base plate 42 connected thereto in an articulated manner, which is why the closing unit 34 is often also referred to as shutter. In the closed position, the slat-like area 40 closes the opening 36, whereas the base plate is mainly received in the receiving slot 32. In the open position, on the other hand, both the slat-like area 40 and the base plate 42 are at least for the most part received in the receiving slot 32. For this, the closing unit 34 is movable in the direction of the arrow P1 in an opening direction.

Figure 4:
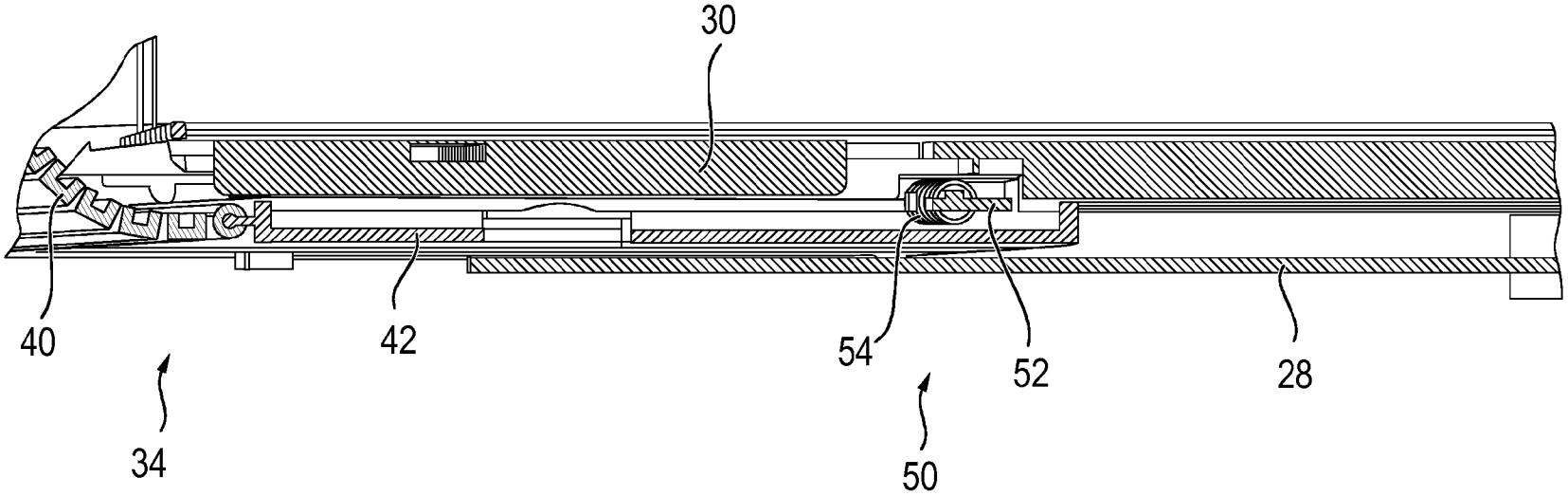
FIG. 4 shows a further sectional view of the cash box according to FIGS. 2 and 3.

In FIG. 4, a detail of a further sectional view of the cash box 10 according to FIG. 3 is shown, the sidewalls 16 to 22 of the housing 14 just like the lower bottom element 28 of the housing 14 being removed.

The cash box 10 has a locking unit 50 by means of which the closing unit 34 can be locked in the closed position. When the locking unit 50 is arranged in a locked state, then the closing unit 34 cannot be moved from the closed position into the open position. In an unlocked state, on the other hand, the locking unit 50 enables movement of the closing unit 34 from the closed into the open position.

Figures 5A, 5B, 5C:
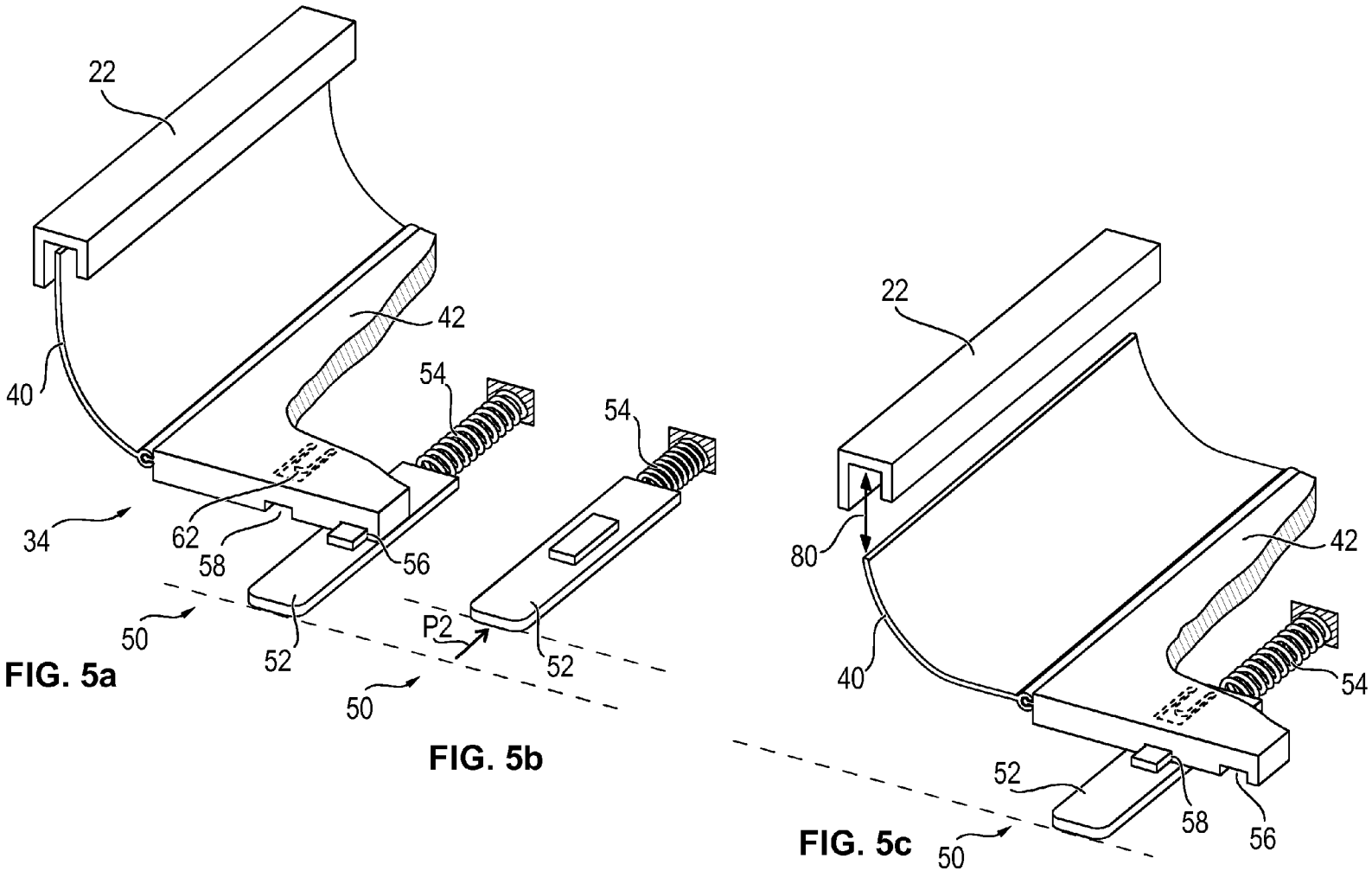
FIG. 5*a* shows a highly simplified schematic illustration of a locking mechanism of a closing unit of the cash box according to the FIGS. 2 to 4 in a first state.
FIG. 5*b* shows a highly simplified schematic illustration of a locking mechanism of a closing unit of the cash box according to FIGS. 2 to 4 in a second state.
FIG. 5*c* shows a highly simplified schematic illustration of a locking mechanism of a closing unit of the cash box according to FIGS. 2 to 4 in a third state.
Figure 6:
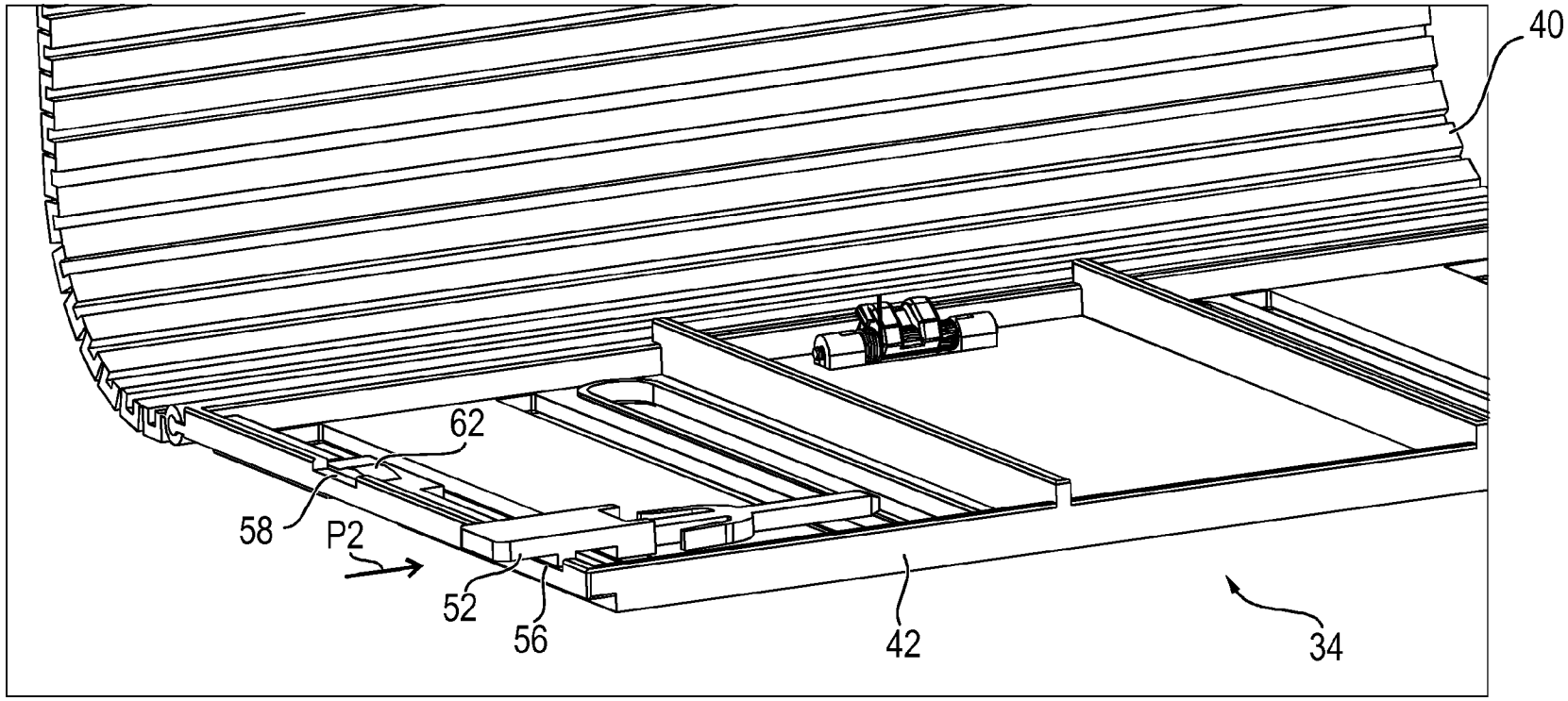
FIG. 6 shows a schematic illustration of a part of the locking and closing unit of the cash box according to FIGS. 2 to 5.
Figure 7:
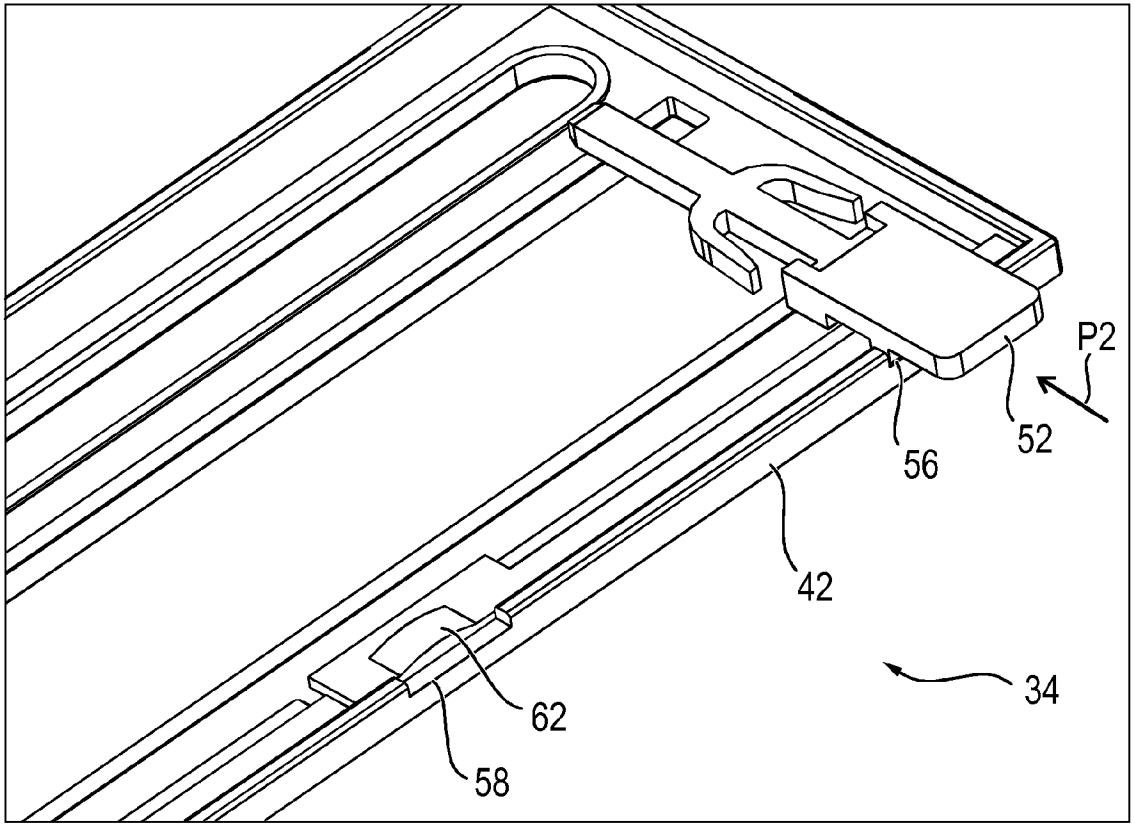
FIG. 7 shows a further schematic illustration of a detail of the locking and closing unit of the cash box according to FIGS. 2 to 6.

In FIGS. 5*a* to 5*c*, a highly simplified illustration of the closing unit 34 and the locking unit 50 is illustrated in various operating states. FIGS. 6 and 7 each show a schematic perspective illustration of the closing unit 34 and a part of the locking unit 50. In the following, with reference to FIGS. 4 to 7, the structure and the functioning of the locking unit 50 are described in more detail.

The locking unit 50 comprises an engagement element 52 which is arranged in one of the locking positions illustrated in FIGS. 5*a*, 6 and 7 via a spring 54. In this locking position, the engagement element 52 is engaged with a first recess 56 of the base plate 42 of the closing unit 34 so that the closing unit 34 cannot be moved from the closed into the open position since the engagement element 52 is mounted to the housing 14, in particular to the upper bottom element 30 immovably in the opening direction P1.

When the engagement element 52 is moved in an unlocking direction P2 against the spring force of the spring 54 into an unlocking position illustrated in FIG. 5*b*, then the locking unit 50 is in the locked state and the engagement element 52 and the recess 56 are no longer engaged so that the closing unit 34 can be moved from the closed into the open position.

Upon insertion of the cash box 10 into the receiving area 106, this pressing of the engagement element 52 from the locking position into the unlocking position takes place via a contact element of the rails 116 so that the unlocking of the locking unit 50 takes place automatically upon insertion. Further, the contact element is designed such that the engagement element 52 is held in the unlocking position during the entire insertion of the cash box 10 and thus during the entire opening of the closing unit 34. The opening of the closing unit 34, too, takes place automatically by means of an engagement with a corresponding element of the receiving area 106 during the insertion of the cash box 10 into the receiving area 106. When closing the closing unit 34 upon removal of the cash box 10, this likewise takes place automatically via the corresponding engagements with the elements of the receiving area 106. Here, too, the engagement element 52 is held in the unlocking position during the entire closing of the closing unit 34 at least until the closing unit 34 is arranged in the closed position.

As viewed in the opening direction P1, upstream of the first recess 56, a second recess 58 is provided in the base plate 42. This second recess 58 is designed such that the engagement element 52 is engaged therewith when the closing unit 34 is moved correspondingly far in the opening direction P1 and is arranged in the locking position. By means of this second recess 52, manipulation attempts shall be prevented or at least be detectable immediately. By manipulation attempt it is in particular meant when a person tries to open the closing unit 34 in an unauthorized manner and thus to reach notes of value received in the cash box 10 through the opening 36.

To open the closing unit 34, such a person has to move the engagement element 52 of the locking unit 50 from the locking position into the unlocking position against the spring force of the spring 54. If the person, however, again releases the engagement element 52, after the engagement between the engagement element 52 and the first recess 56 has been disengaged and after the closing unit 34 has been slightly moved in the opening direction P1, then this engagement element again moves into the locking position due to the restoring force of the spring 54 and, provided that the closing unit 34 is moved correspondingly further in the direction P1, automatically engages with the second recess 58 so that a further movement of the closing unit 34 in the opening direction P1 is not possible. As the base plate 42 is completely covered by the housing 14, the person cannot see the second recess 58 so that he/she does not know that he/she must hold the engagement element 52 in the unlocked position all the time. If, on the other hand, the person succeeds in holding the engagement element 52 in the unlocked position for a sufficient amount of time during the opening, then the person can open the closing unit 34 and thus possibly reach received notes of value. If this person, however, again closes the closing unit 34 after a possible removal of the notes of value to thus cover up the manipulation attempt and the theft of the notes of value, then the engagement element 52 likewise engages with the second recess 58.

In FIG. 5*c*, this state in which the engagement element 52 is arranged within the second recess 58 is shown. In this state, the closing unit 34 is arranged in an intermediate position in which it is indeed slightly open but only a small gap 60 is opened between the sidewall 22 of the housing 14 and the closing unit 34. Thus, it can easily be detected that someone tried to open the closing unit 34 without permission so that action against such a manipulation attempt can be taken immediately.

The distance between the first recess 56 and the second recess 58 is in particular chosen such that the gap 60 is so small that no access to notes of value received in the cash box 10 is possible via this gap.

Further, on the base plate 42, a limiting element 62 is provided in the area of the second recess 58 by means of which a movement of the engagement element 52 in the unlocking direction P2 is prevented when the engagement element 52 is engaged with the second recess 58. In this way, it is achieved that the engagement element 52 can no longer be moved from the locking position into the unlocking position so that the engagement between the engagement element 52 and the second recess 58 can no longer be disengaged from outside of the cash box 10. This is only possible via the opening 26 of the cash box 10. Since for this, however, a key for opening the cover is required, this cannot be carried out by the person performing the manipulation so that this person has no other choice but to leave the closing unit 34 in the intermediate position according to FIG. 5*c*.

Thus, by means of the locking unit 50 it is guaranteed that an unauthorized access to the notes of value by means of an unauthorized opening of the closing unit 34 is prevented or can at least be detected immediately.

In a preferred embodiment, the limiting element 62 can, as illustrated in FIGS. 6 and 7, be designed in the simplest form as a small projection by means of which a pressing of the engagement element 52 into the cash box 10 is prevented.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A cash box, comprising:

a receiving area for receiving a value note stack, a housing having an opening for feeding notes of value to the receiving area and/or for removing notes of value from the receiving area, a closing unit for closing the opening of the housing, which, in a closed position, closes the opening and, in an open position in which the closing unit is moved in an opening direction relative to the closed position, uncovers the opening at least so far that notes of value are feedable and/or removable, and comprising a locking unit which, in a locked state, prevents an opening of the closing unit arranged in the closed position and, in an unlocked state, enables an opening, wherein the locking unit comprises a first engagement element mounted to the housing, which, in the locked state, is arranged in a locking position in which it engages with a second engagement element of the closing unit, and wherein the closing unit comprises a third engagement element which is arranged and designed such that the first engagement element arranged in the locking position engages with the third engagement element when the engagement between the first engagement element and the second engagement element is disengaged and the closing unit is moved in the opening direction without unlocking the locking unit.

2. The cash box according to claim 1, wherein the closing unit is constructed as a roller shutter.

3. The cash box according to claim 1, wherein the closing unit comprises a plurality of slats having a first width and a base plate having a second width, the second width being greater than the first width.

4. The cash box according to claim 3, wherein the second engagement element and/or the third engagement element are arranged on the base plate.

5. The cash box according to claim 3, wherein the second engagement element and/or the third engagement element are designed as a recess in the closing unit.

6. The cash box according to claim 1, wherein the closing unit comprises a curved element and a base plate connected to this curved element in an articulated manner.

7. The cash box according to claim 1, wherein the third engagement element is arranged upstream of the second engagement element as viewed in the opening direction.

8. The cash box according to claim 1, wherein the distance between the second engagement element and the third engagement element is provided such that, when the first engagement element engages with the third engagement element, the closing unit closes the opening at least so far that no access to the notes of value received in the receiving area is possible.

9. The cash box according to claim 1, wherein the distance between the second engagement element and the third engagement element is provided such that, when the first engagement element engages with the third engagement element, the closing unit is arranged in a position that is distinguishable visually from the closed position.

10. The cash box according to claim 1, wherein the third engagement element is designed such that the engagement between the first engagement element and the third engagement element is only disengageable by opening a cover of the cash box.

11. The cash box according to claim 1, wherein the third engagement element is designed and/or arranged such that the first engagement element, when arranged in the locking position, engages with the third engagement element when the closing unit is moved from the open position into the closed position.

12. The cash box according to claim 1, wherein the first engagement element is biased into the locking position by means of an elastic element, and that the first engagement element is movable in an unlocking direction into an unlocking position against the restoring force of the elastic element.

13. The cash box according to claim 12, wherein the first engagement element, when held in the unlocking position against the restoring force, does not engage with the second engagement element and the third engagement element when the closing unit is moved from the closed into the open position and/or from the open into the closed position.

14. The cash box according to claim 12, wherein the third engagement element, when engaged with the first engagement element, prevents a movement of the first engagement element in the unlocking direction.

15. The cash box according to claim 14, wherein the third engagement element comprises a limiting element, which delimits a reception area in which at least a partial area of the first engagement element is received when the first engagement element and the third engagement element are engaged with each other toward the unlocking direction.

* * * * *